US007892642B2

(12) United States Patent
Van Malderen

(10) Patent No.: US 7,892,642 B2
(45) Date of Patent: Feb. 22, 2011

(54) MONOFILAMENTOUS STRING

(75) Inventor: Dominique Van Malderen, Schilde (BE)

(73) Assignee: LUXILON INDUSTRIES, naamloze vennootschap, Wijnegem (BE)

( * ) Notice: Subject to any disclaimer, the term of this patent is extended or adjusted under 35 U.S.C. 154(b) by 0 days.

(21) Appl. No.: 12/540,156

(22) Filed: Aug. 12, 2009

(65) Prior Publication Data

US 2010/0040878 A1 Feb. 18, 2010

(30) Foreign Application Priority Data

Aug. 14, 2008 (BE) ..... 2008/0452

(51) Int. Cl.
*D02G 3/00* (2006.01)

(52) U.S. Cl. ..... 428/397; 428/370; 428/374; 428/373

(58) Field of Classification Search ..... 428/397, 428/370, 373, 374
See application file for complete search history.

(56) References Cited

U.S. PATENT DOCUMENTS

| | | | | | |
|---|---|---|---|---|---|
| 3,705,226 | A | * | 12/1972 | Okamoto et al. | 264/162 |
| 3,718,534 | A | * | 2/1973 | Okamoto et al. | 428/374 |
| 4,127,696 | A | * | 11/1978 | Okamoto | 428/373 |
| 4,233,355 | A | * | 11/1980 | Sato et al. | 442/195 |
| 4,369,156 | A | * | 1/1983 | Mathes et al. | 264/147 |
| 4,381,335 | A | * | 4/1983 | Okamoto | 428/373 |
| 4,496,619 | A | * | 1/1985 | Okamoto | 442/335 |
| 5,336,804 | A | * | 8/1994 | Blanchard et al. | 558/319 |
| 5,413,857 | A | * | 5/1995 | Hagen et al. | 428/357 |
| 5,573,850 | A | * | 11/1996 | Cunningham et al. | 428/373 |
| 5,620,797 | A | * | 4/1997 | Mallonee | 428/373 |
| 6,468,651 | B2 | * | 10/2002 | Aikawa et al. | 428/364 |

FOREIGN PATENT DOCUMENTS

| | | | |
|---|---|---|---|
| JP | 2007-282661 | * | 1/2007 |
| JP | 2007-229284 | | 9/2007 |
| JP | 2007-282661 | | 11/2007 |
| JP | 2007-330772 | | 12/2007 |

OTHER PUBLICATIONS

Search Report of European Patent Office regarding Belgium Patent Application No. 2008/00452, Feb. 13, 2009.

* cited by examiner

*Primary Examiner*—N. Edwards
(74) *Attorney, Agent, or Firm*—Bacon & Thomas, PLLC

(57) ABSTRACT

Monofilament string suited for use in tennis rackets and the like, consisting of a core material and a covering material that serves as a matrix, in which the core material is embedded in the covering material in accordance with the 'island in the sea structure' and that therefore contains island components and a sea component, whereby the island components largely but not exclusively consist of a thermoplastic polymer; are arranged in a geometrical and preferably symmetrical pattern relative to each other and/or the longitudinal axis of the string; and at least three of the island components have a cross-section that has a multi-angular shape, with one side leaning close against the surface of the string. The one side has a curvature that closely lines the curve of the string surface, and the sea component largely but not exclusively consists of a thermoplastic elastomer.

20 Claims, 5 Drawing Sheets

MONOFILAMENTOUS STRING

BACKGROUND

A. Field

The present invention concerns a monofilament string.

B. Related Art

This mainly includes, but is not limited to, a monofilament string that can be used for stringing rackets for ball sports such as, for example, tennis, squash, racket ball, badminton and the like.

The invention however also concerns a monofilamentstring or thread that can be used for, for example, fishing, or in musical instruments, etcetera.

More specifically, the invention is intended for a polymer string or thread that is manufactured as monofilament in a bicomponent extrusion process and that consists of various polymers that are arranged in a clearly set pattern in accordance with the so-called 'island in the sea' concept compared to each other.

This concept consists of using various polymers or polymer mixtures separately in the same monofilament string, and arrange them in such a geometrical manner versus one another that, if one looks at a cross-section of the manufactured string, this appears to be a manifold of separate cores or 'little islands', shaped by a certain polymer or a group of polymers, surrounded and kept in place by a matrix or 'sea', mainly but not necessarily exclusively consisting of another polymer or a group of other polymers.

In order to provide optimum strength and tensile strength, a mixture of two or more various polymers can be chosen, or yet another polymer or group of polymers can be used that consists of linearly segmented block copolymers that contain a sequence of hard and soft segments.

The polymer or the polymer mixture of the 'sea component' is at first chosen in such a way that it displays an optimum compatibility, especially an optimum bonding to the 'island components'.

Furthermore, the 'sea component' preferably contains a polymer elastomer, for example a thermoplastic polyether polyester elastomer, which decreases stiffness and improves the elasticity of the part of the string that surrounds the 'island components' without negatively influencing the recovery of the string after elastic distortion, so that a constant quality of the string can be guaranteed over a long period of use.

The invention also concerns a method for manufacturing such a string.

In practice one already knows various sorts of polymer strings that distinguish themselves from each other both as far as their construction and as far as their composition are concerned.

However, these types of strings all have their own typical characteristics, together with the specific advantages and disadvantages that come with them.

With this not only their physical, chemical and sensory characteristics are meant, such as for example elasticity modulus, breakage and tensile strength, tension relaxation, loop strength, abrasion resistance, resistance against influences of high humidity, temperature, radiation and/or the like.

But also their playing characteristics, in professional terms indicated with power and control, ball sensitivity and touch, comfort, spin, performance, elasticity, ball speed, etc.

It is also important how these characteristics materialise under different playing conditions, such as for example how the ball control behaves both when playing soft and when playing hard.

In general, it can be stated that the player should experience the same ball feeling both when playing soft and when playing hard.

Also, these characteristics should include the sound that is produced by the impact of the ball or the shuttle on the string.

This is indeed regarded as essential for the success of the game.

Sound is namely used as sign of recognition when exchanging hits.

Especially in the case of badminton the most sought-after strings produce a certain sound that can so far only be reproduced by the use of natural strings or by a specific sort of polymer strings.

In this context strings for tennis rackets made of natural gut are generally known.

They are made of animal gut that is processed by means of a time-consuming and complex procedure.

The primary characteristics hereof are superior elasticity, tension stability, and liveliness.

On the other hand, these strings are rather expensive and sensitive to weather conditions, especially to high humidity.

Furthermore strings for tennis rackets are known that are based on a polymer basis and that are designed either as monofilament or as multifilament, and this in strongly deviating shapes.

Mostly, the monofilament strings consist of a single thread of polyester or aromatic polyamides, provided with a thin outer protection and finishing layer.

It is generally assumed that the diameter of this, especially for tennis strings, is between 1.1 to 1.35 mm and for badminton strings for example between 0.6 to 0.8 mm, which is mainly decisive for the eventual playing characteristics that can range from elastic to durable.

The strings were mostly experienced as relatively stiff but on the other hand generally have a higher durability.

They often also have the tendency to relatively quickly loose their tension, as a result of which the control diminishes and the string feels 'dead'.

It is generally assumed that the monofilamentstrings allow for a better control of the ball when playing hard, but that this could still be improved when playing soft.

They are also not capable, especially in the case of badminton, to produce the desired sound upon impact of the shuttle or ball.

This sound namely serves as a sign of recognition when exchanging hits and is generally regarded as essential for the success of the game.

Classical are on the other hand multifilament strings, in which often a large amount of microfibres, possibly designed from various materials, are twined into a same string that is subsequently provided with a resisting cover layer.

As advantage of these multifilament strings their high elasticity is mentioned mostly.

It is generally assumed that the multifilament strings allow for a better control of the ball when playing soft, but that this could still be improved when playing hard, as opposed to monofilament strings.

These type of strings furthermore have the disadvantage that they tend to snap as soon as the protective layer is damaged.

For this reason they are therefore mostly experienced as vulnerable.

Furthermore, because of their complex structure and complicated production method, they are fairly expensive, since the separate filaments first have to be woven to a string before they can subsequently be embedded in a matrix.

Poor bonding of this matrix to the interwoven multifilament strings and letting loose of the various constituting parts (defoliation, delamination) is a known disadvantage hereof and constitutes an important limitation of their useful lifespan.

Also generally known is the use of hybrid strings, which is understood to mean that a different type of strings is used for the stringing of a racket lengthwise, e.g. monofilament strings as discussed above, compared to the stringing widthwise, where for example multifilament strings find their application.

However, these hybrid strings lead to difficulties when optimally stringing a racket, and it is not uncommon to have to call upon more complicated stringing techniques.

In JP 2007330772 of the company Toray Monofilament Co., a monofilamentstring is described of the 'island in the sea structure' in which the 'island components' consist of a thermoplastic polyester in which 1 to 40 percent by weight of the polymer is replaced by the same material that is used for the creation of the surrounding 'sea component', the latter namely consisting of at least a thermoplastic polyamide, fluorinated polymer, or a polyolefin, but preferably of a polyamide.

The number of 'island components' is between 7 and 25.

The diameter of the string is typically 0.5 to 1.5 mm and the tensile strength 3.0 to 8.0 cN/dtex.

The shape and arrangement within the thread of the island components is not specifically determined, however.

Still it is stated that triangles, round shapes, rectangles, leaf shapes with three or five sided branches are possible, however, without indicating specific advantages of a specific shape or arrangement or expressing a preference.

Also, it is stated that a symmetric arrangement is possible, with which in the aforementioned context a rotational spiral-shaped symmetry is intended, as is usual for tennis strings and can be realised or imposed only by torque, twining or twisting from the outside, and which is therefore no inherent characteristic of a specific island structure of the string.

On the other hand, JP 2007282661 of the company Gosen KK, describes a monofilament string, also of the 'island in the sea structure', for 40-90 percent by weight consisting of an 'island component' and for 10-60 percent by weight of a 'sea component' and in which at least 13 island components are present.

The 'island components' are shaped in this from at least one polyamide, polyester or polyolefin, with a preference for a polyamide, and have a diameter of 0.05 to 0.2 mm.

In that, the 'sea component' consists of at least one thermoplastic elastomer polyurethane, polyester, polyamid or polyolefin, with a preference for polyurethane.

Such a string finally has a tensile strength of 3.0 to 5.5 cN/dtex.

In this case there is also only a reference to a geometric pattern of the island components, without stating any specific arrangement or advantages thereof, with the exception of rotational symmetry that, as indicated above, can also only be implemented or realised from the outside, and can therefore not be regarded as a specific characteristic of the island structure.

A known advantage with all these monofilament strings is that they still have a stiffness that is too high which allows for too little control over the ball, and that when playing hard or soft can be held responsible for a clearly different ball feeling, apart from the previously already mentioned classical disadvantages.

SUMMARY OF THE DISCLOSURE

The present invention has the objective to offer a solution to the aforementioned and other disadvantages of the current, both mono and multifilament strings, as well as of natural strings such as hybrid strings, because it provides for a monofilament string that is suitable for the use in tennis rackets and the like, consisting of a core material and a covering material that serves as a matrix, and the core material is embedded in the covering material in accordance with the 'island in the sea structure', a monofilament string that therefore contains 'island components' and a 'sea component' whereby the island components largely but not exclusively consist of a non-elastomeric thermoplastic polymer, whereby they are arranged in a geometric and preferably symmetric pattern relative to each other and/or the longitudinal axis of the string, and whereby at least three of these island components (2) have a diameter that is of a multi-angled shape, and with one side leaning close against the surface of the string, and whereby the curvature of this side closely lines the curve of the surface, and whereby the sea component largely but not exclusively consists of a thermoplastic elastomer.

A huge advantage of a string according to the invention is that the good characteristics of a typical monofilament string, for example of a Luxilon Big Banger Alu Power, remain completely preserved, but are upgraded in such a manner that the new string at the same time also shows the typical characteristics of hybrid strings and multifilament strings.

A remarkable characteristic hereof is that the string according to the invention has a longer contact time together with a higher deformation.

This results in the ball or the shuttle remaining longer on the string.

Thus it becomes possible to realise a better ball feeling, and this with full preservation of the advantages of a monofilament string such as the Big Banger Alu Power, meaning a high durability and no or almost no loss of tension.

A further advantage of a string according to the invention is that the enhancement is increased with regard to a monofilament string.

A lower E modulus is namely achieved and will have a softer string.

At the same time a more supple feeling is achieved during playing, which results in better comfort and ball feeling.

The low energy return that is measured, also indicates that the ball remains longer on the string and that still the same energy returns comparable with that of a Big Banger Alu Power monofilament string can be realised.

New characteristics are in this way realised in one and the same string, whilst fully maintaining the advantageous characteristics of a monofilament string, which is the main reason for the use according to the present state of the art of hybrid strings.

The characteristics of multifilament strings and of hybrid strings are, according to the invention, namely realised in a string whereas the good characteristics of a monofilament string, for example of the Big Banger Alu Power type, are completely preserved.

A further advantage of the string according to the invention is that the desired characteristics of the new string are obtained during production in one step.

This is contrary to the state of the art in which, especially with multifilament or woven strings, a multitude of production and treatment steps are necessary for the often gradual construction of the desired characteristics.

Because of this, the production is drastically simplified and the production time is drastically shortened with a better control of the process parameters, which reflects amongst others in a more consistent quality, lower costs, less energy and material use, and also in a decrease of the environmental impact and decreased emission of gasses which affect the greenhouse effect.

Another important advantage of a monofilament string according to the invention is that it provides improved playing characteristics, especially enables a better control of the ball that is furthermore tuned on the playing form, playing experience, and quality.

With this invention a monofilament string is namely provided of which the strength, stiffness and playing characteristics can be set independently from each other, by making an adequate choice of the polymers of which the 'island components' (the core) and the 'sea component' (the matrix) are constructed respectively, and by the specific geometry that is given to these 'island components'.

Furthermore, a racket equipped with the string according to the invention is not only characterised by a similar auditive acoustic profile as when using the current, more expensive and less durable multifilament and woven strings, therefore by the same sound perception along the side of the player.

The latter is generally regarded as essential for the success of the game since it counts as a very important recognition parameter for the players.

Amongst others, it determines their reaction and provides information on touching the ball and the ball feeling.

The acoustic profile of a tennis string according to the invention is furthermore the same for a certain type of hitting, depending on the type of soil and depending on the fact of whether the player plays outdoor or indoor.

Another huge advantage is that in case of compression of the string one locally obtains a relatively large surface of island components and island material, close to the outside of the string, and this is because of the typical symmetric location of these island components according to the invention and by pushing back the underlying and other dynamically collaborating island components.

This will be demonstrated more closely further on when discussing FIGS. 2 and 3.

Since this island material will at most be against the outside of the string when it bends, and is furthermore condensed by compression, one obtains according to the invention excellent characteristics, especially as far as improved cushioning is concerned, which in turn results in a better shock absorption.

This effect was extensively studied and documented by means of players' tests that were carried out under different playing conditions.

A large advantage and direct consequence thereof is that by applying a string in accordance with the invention one obtains an excellent control over the ball that, according to the current techniques, was previously not possible.

Another mayor advantage is that when playing softly, one obtains the feeling of a multifilament string and when playing hard, one obtains the feeling of a monofilament string.

One namely obtains constant ball control at a continuous bending of a string according to the invention. Finally, a smoother and non-delaminating or exfoliating surface structure of the strings according to the invention allows to produce rackets that bend better when playing, and with which the strings move less, which results in better ball control, a nicer playing feeling, and a longer useful lifespan.

In a preferential form the string consists mainly of a polymer or several polymers or polymer mixtures selected from one or several of the following groups of polymers or polymer families: PET, co-PET, PLA, PBT, PPT, PA and/or copolymers of these materials, PEEK, PPS, polyether-polyester block polymer, polyether-polyamide block polymer, TPU, PVDF and/or other fluorinated polymers.

In a further preferential form it contains at least a polyester made from a dicarboxylic acid from the group of phthalic acid, isophthalic acid, adipic acid, sebacic acid, 2.6 naphthalene dicarboxylic acid and a diol chosen from the group of a polyalkylene glycol, diethylene glycol, propylene glycol, tetramethyleneglycol, 1,4 cyclohexane diol, or copolymers of these polyesters or blends of two or more of such polyesters or copolymers thereof.

In another preferential form it contains at least a polymer or polymer mixture selected from the group of thermoplastic elastomers, especially polyolefins, especially thermoplastic olefins (TPO); polyethylene and thermoplastic polyethylene; polypropene; ethylenepropene copolymers, especially EPDM, polyisoprene and copolymers thereof, polybutadiene and copolymers thereof, polyisobutylene and copolymers thereof; polyesters for example polyethylene terephthalate (PET) and PLA, or copolymers thereof; thermoplastic polyurethane (TPU) and copolymers thereof, styrenebutadiene styrene copolymers and block copolymers, polyethers, polyesters, polyether esters, polyphenylene oxide, polyether etherketone (PEEK), PEEKK (polyether etherketoneketone), ABS, polymethyl acrylate and polymethyl methacrylate, ethylenetetrafluorethylene, ethylenechlorotetrafluorethylene, polyvinylidene fluoride (PVDF), on teflon based polymers such as FEE, MFA and PFA and mixtures of two or more of these polymers or mixtures that contain one or more of the aforementioned polymers.

In yet another form the string contains at least one plastic that consists of a thermoplastic material in which at least one alkylbenzyl ester of a 1,2 dicarboxylic acid, or one of its derivates, is homogeneously distributed and whereby the alkyl chain of the alkylbenzyl ester, or one of its derivates consists of at least five carbon atoms.

This alkylbenzyl ester can furthermore consist of a diester of phthalic acid or phthalic acid anhydride, with a benzyl group on one hand, and an alkyl group with five to twelve carbon atoms on the other hand, especially with seven to nine carbon atoms, especially with an isononyl group or with a group consisting of a mixture of the corresponding isomers.

To that end, the island components can largely, but not exclusively, be constructed with at least one plastic from the group of the thermoplastic polyurethanes and/or a copolymer and/or block copolymer and/or a mixture of two or more of these polymers and/or a mixture that contains one or more of the aforementioned polymers and that the shore hardness is between A40 and D85, even better between shore A70 to D70.

They can for example mainly, but not exclusively, exist of at least one polymer selected from the group of the fluorinated polymers, especially polyvinylidene fluoride and/or a copolymer and/or a block copolymer and/or a mixture of two or more of these polymers and/or a mixture that contains one or more of the aforementioned polymers.

Furthermore, the sea component can largely, but not exclusively be formed by at least one polymer from the group of the polymeric phthalates, especially by polyethyleneterephthalate and/or a copolymer and/or a block copolymer and/or a mixture of two or more of these polymers and/or a mixture that contains one or more of the aforementioned polymers.

Or for example also consist of amongst others a mixture of polyvinylidenefluoride and polyethylene terephthalate or one or several derivates thereof.

In a further preferential form the composing polymers or polymer mixtures can be selected from the group of polyamides, especially nylon 6, nylon 66, nylon 11, nylon 12, or nylon 46 or copolymers thereof; or from the group of the polyesters, especially polyethyleneterephthalate (PET) and PLA polyether ketones, especially polyether etherketone (PEEK), PEEKK, poly-oxymethylene (POM), polyvinylidene fluoride (PVDF), copolymers of polyesters or mixtures of two or more of these polymers.

Preferred are the polyesters that have a melting temperature between around 250° C. and 275° C.

In a further preferential form the island components and/or the sea component contain the usual additives, such as functional additives, for example nanoparticles created by one of the composing plastics and/or for example fillers such as titanium dioxide, silica, aluminium oxide, calcium carbonate, clay, derivates, siliconnitride, zirconiumoxide and/or active stabilisers such as anti-oxidants, UV absorbers, etc.

The presence of aforementioned nanoparticles in the material of the 'sea component' namely influences the surface of the string and influences the playing behaviour of the string in that way.

The presence of aforementioned nano particles in the material of the 'island components' offers the advantage that savings can be made on more expensive fillers and additives, especially when using nanoparticles of the recycled main materials.

DESCRIPTION OF THE DRAWINGS

With the intention to better demonstrate the characteristics of the invention, hereinafter as an example without any limiting character, the characteristics of a preferential form are displayed from the string according to the invention, compared with those of two known current strings, with reference to the accompanying drawings, in which.

DETAILED DESCRIPTION OF PREFERRED EMBODIMENTS OF THE INVENTION

Figure 1:
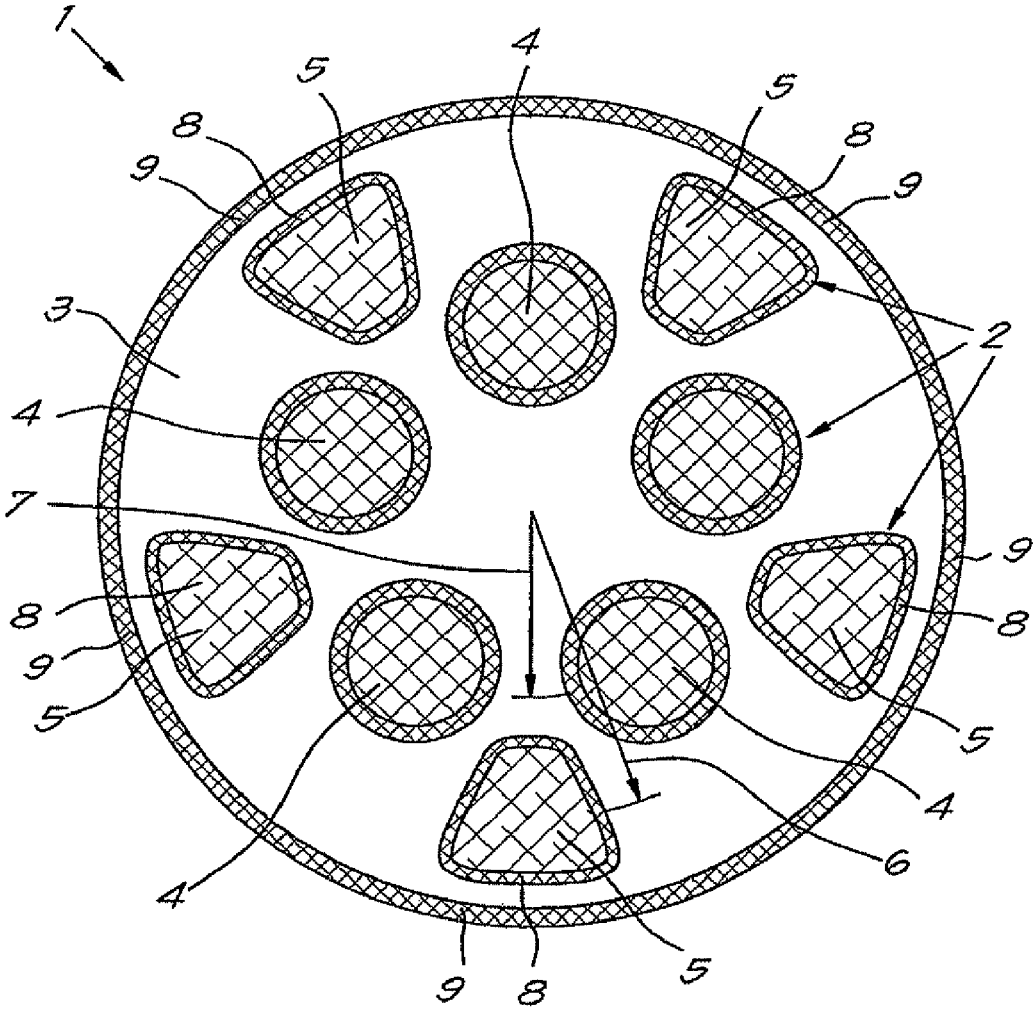
FIG. 1 displays a cross-section of the monofilament string of this invention crosswise on the length-direction of the string.

FIG. 1 displays a cross-section 1, crosswise to the longitudinal direction of a string 1 according to the invention.

In this figure the cross-section of the string 1 crosswise on the longitudinal direction of the string 1 is displayed having a round shape because co-axially with a wall of the string 1 on a first and second distance of the axis of the string a first and second series of island components 4 and 5 have been applied that are executed in the same or a different material.

The cross-section of a string according to the invention can for example also be an oval, or flat-ended, or of an angular form.

The string 1 is composed of island components 2 that are embedded in a sea component 3.

The island components 2 consist of various polymers or polymer mixtures of which a first type is applied in the shape of islands 4 that display and essential round shape and the other 5 in the shape of little islands that moreover display a multi-angular pattern.

Both types of islands 4 and 5 respectively have been arranged in a sequentially alternating order and are located concentrically compared to the center line of the string, at a distance 6 and 7 from the center point of the cross-section respectively.

The multi-angular little islands 5 are furthermore arranged in such a way that they lean with a long side 8 close to the surface 9 of the string, and are executed in such a way that this long side 8 essentially runs parallel to the outer wall 9 of the string 1.

Figure 3:
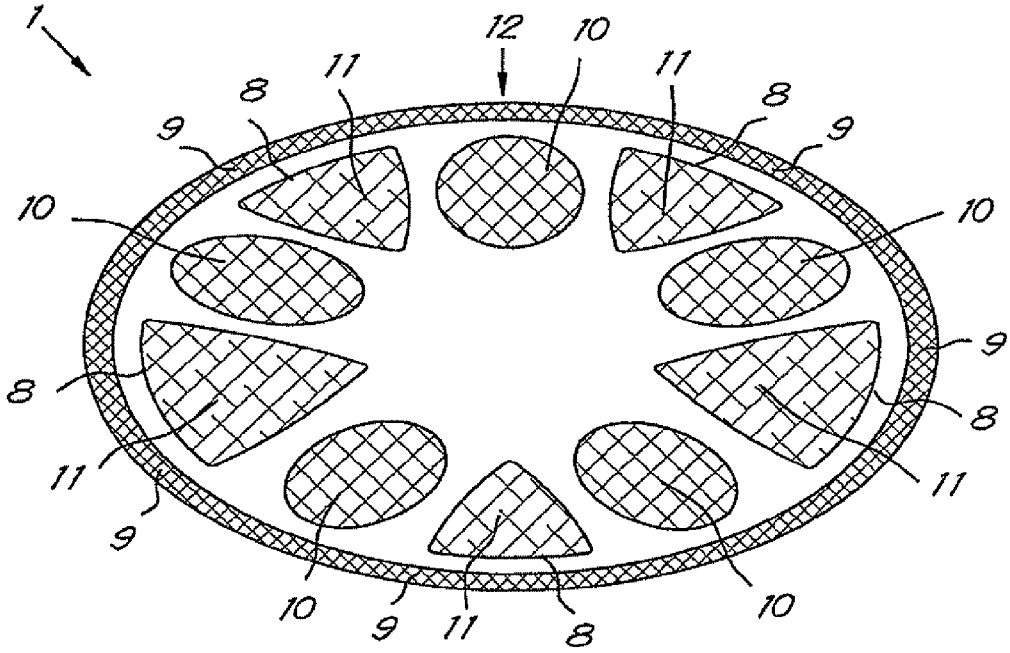
FIG. 3 displays the deformation of the string from FIG. 2 under the influence of a load.

Such a pattern allows to increase, in case of bending or compression, the concentration of island components and island material locally, just under the string surface, as will be demonstrated more closely in FIG. 3.

Such an arrangement of the various islands 4 and 5 in the sea component 3 and the responsible selection of the various composing polymers and polymer mixtures, together with the bicomponent extrusion process, allow for the characteristics of a typical monofilament string such as for example the Big Banger Alu Power to be improved in such a way that the string according to the invention displays at the same time also the specific characteristics of a multifilament string and of a hybrid string.

Furthermore, the good characteristics that belong to a specific monofilament are completely preserved.

Figure 2:
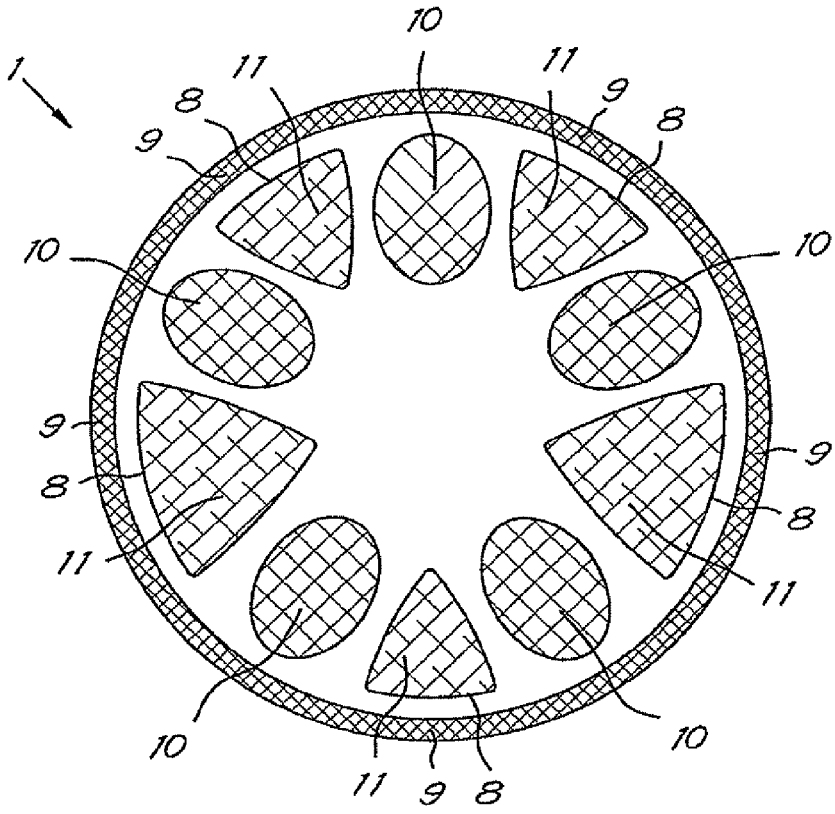
FIG. 2 displays a similar cross-section but of a variation of the string from FIG. 1.

In FIG. 2 a cross-section crosswise on the longitudinal direction is displayed of a Variation of the string from FIG. 1.

In this figure we encounter once again the same constructive elements as in FIG. 1, but with this difference that the various types of island components are arranged differently this time, to such an extent that they show an alternating pattern of oval 10 and triangular elements 11, at which a large number of multi-angular elements 11 with a long side 8, are closely applied to the outside wall of the string 1, and at which this long side 8 essentially runs parallel with the outside wall 9 of the string.

FIG. 3 displays schematically how the various island components 10 and 11, displayed in unloaded circumstances in FIG. 2, are deformed dynamically by exerting a force in the direction as indicated by the arrow 12.

In here one clearly sees how by applying the force and the deformation resulting from that, the concentration of island components 10, 11 and therefore also to the island material, has locally increased along the outside of the string 1 and the long side 8 of the multi-angular island components 11 still has been increased, whereas the oval island components 10, depending on their location, are either compressed or extended, in order to offer, in dynamic collaboration with the surrounding island components 10 and surrounding island components 11 maximally and especially well dosed a controlled resistance to the implemented deformation.

Because the island material will, during deformation, be located maximally on the outside and furthermore closer to each other, one obtains with a string according to the invention an increased cushioning, which results in a better shock absorption and an excellent ball control both when playing soft and hard, apart from producing a constant sound for a specific type of hit, independent from the type of soil and whether one plays indoor or outdoor.

This sound is furthermore very constant at every determined force that is exerted on the tennis string 1 according to the invention.

Figure 4:
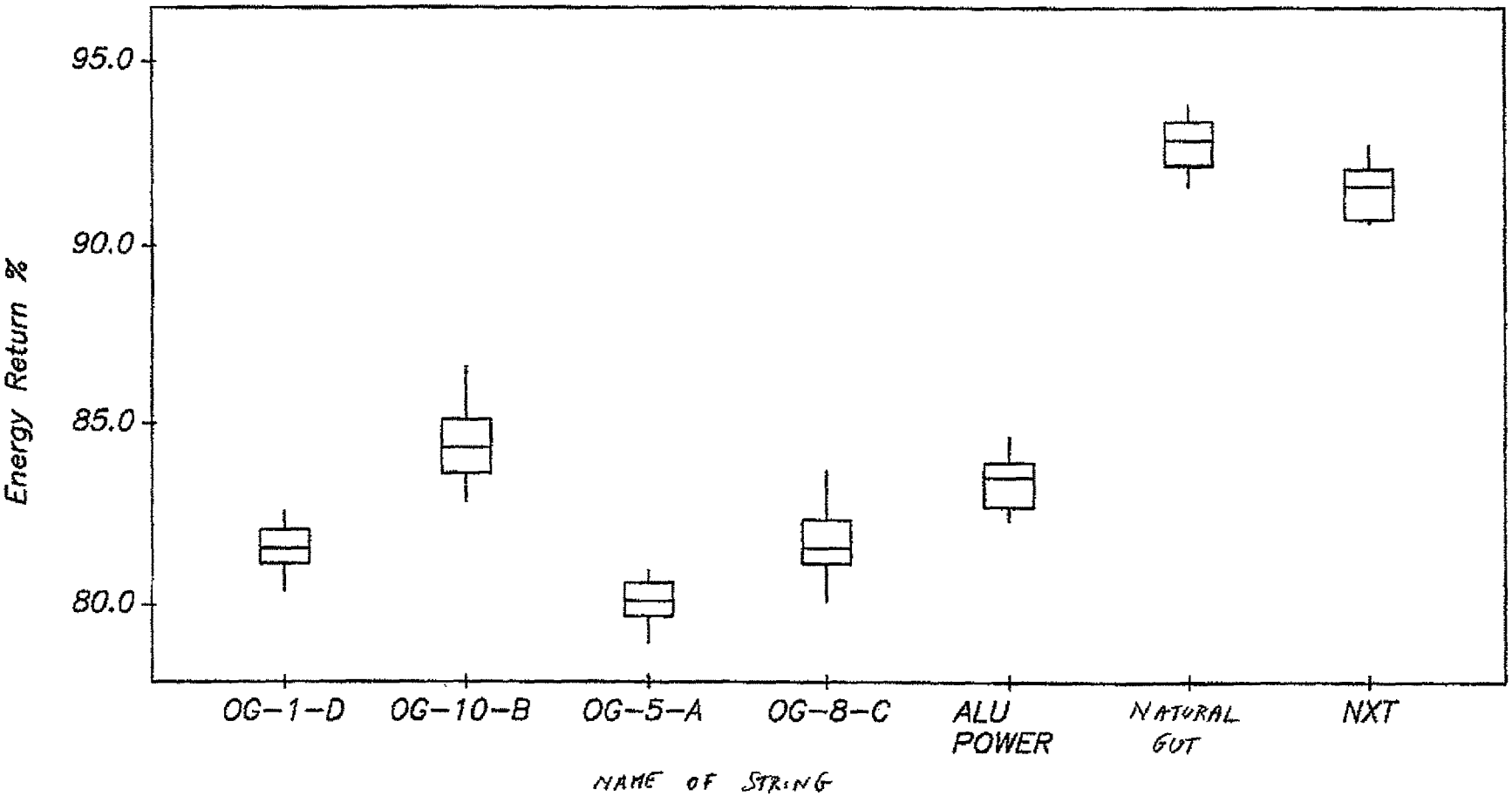
FIG. 4 displays a comparison of the 'energy return' between various strings.

In FIG. 4 a block diagram displays a comparison of the 'energy return' between a string according to the invention 0G-1-D; 0G-10-B; 0G-5-A and 0G-8-C, a typical multifilament string, displayed by NXT and a typical monofilament string, displayed by Alu Power and a typical string made of natural gut.

One sees that because of the lower values of the 'energy return' the ball remains longer in the string for strings according to the invention, but that despite of that a same 'energy return' is realised as the one from the typical monofilament string Big Banger Alu Power.

Figure 5:
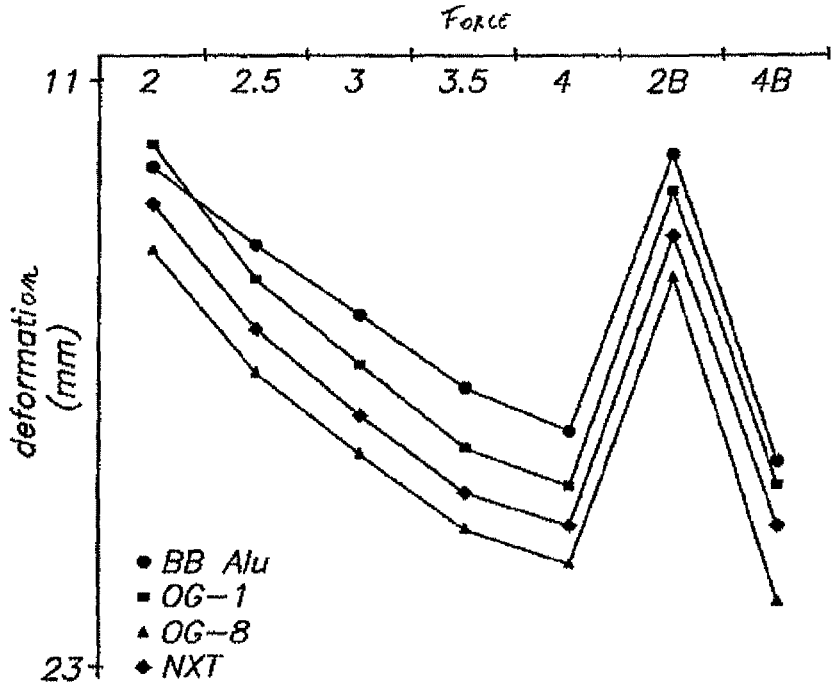
FIG. 5 displays a comparison of the deformation between various strings.

In FIG. 5 a comparison is displayed between the deformation obtained between various strings, which displays the duration of the time that the ball remains in the string bed.

Furthermore, we notice that the ball enters deeper at the NXT multifilament string than at the typical monofilament string Big Banger Alu Power, in the figure displayed by BB Alu.

The strings according to the invention 0G-1 and 0G-8 have a deformation that tends more to that of the NXT multifilament string than to that of the Big Banger Alu Power monofilament string.

Figure 6:
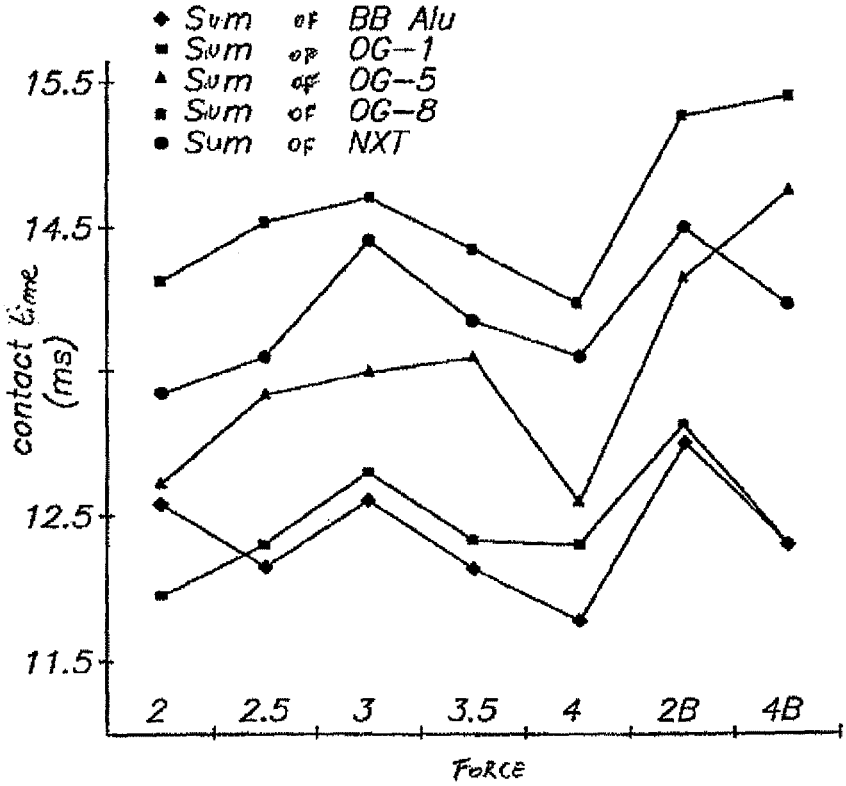
FIG. 6 displays a comparison of the contact time between various strings.

In FIG. 6 the contact time for various strings is displayed in milliseconds at various racket speeds.

Once again one notices that the contact time of the strings according to the invention 0G-5 and 0G-8 approximate those of the typical multifilament string, displayed by NXT.

The contact time of the string according to the invention 0G-1 can be adjusted in such a manner by the selection of the ingredients, construction and production process, that it approximates the contact time of the typical Big Banger Alu Power monofilament string, displayed by BB Alu quicker.

Figure 7:
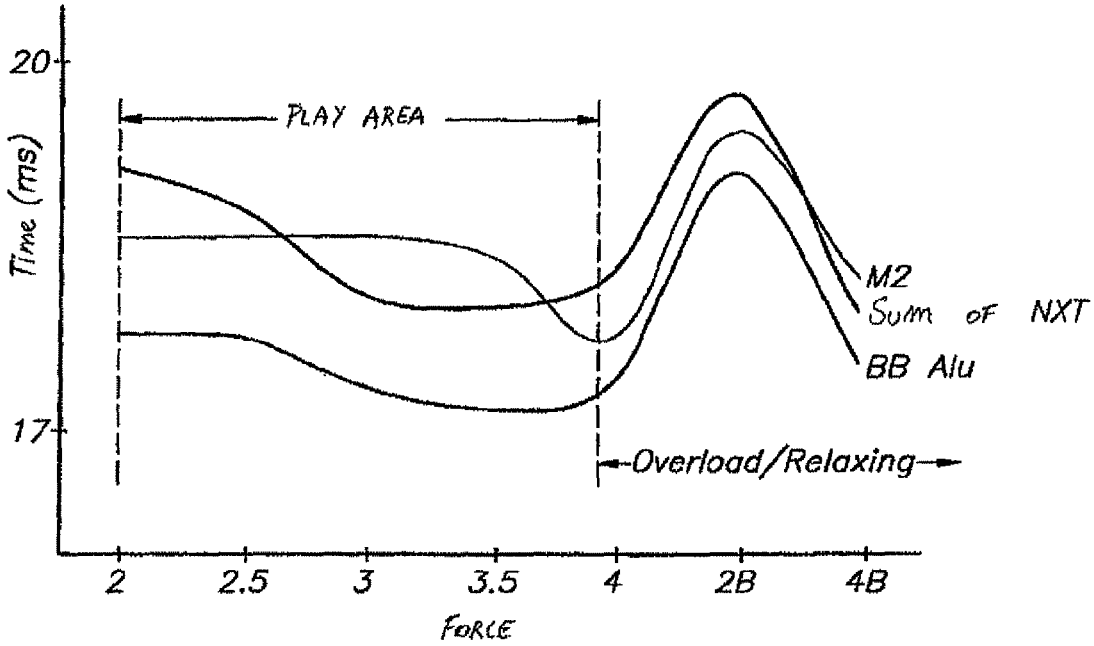
FIG. 7 displays a further comparison of the contact time between various strings.

In FIG. 7 the contact time for various strings is displayed once again. This indicates how long the ball remains in the string bed at a given impact force, that depends on the speed of the ball and the racket respectively.

The string according to the invention, here displayed by M2, approximates the contact time of the typical NXT multifilament string, but the figure also shows that the contact time in the playing zone displays a rather horizontal plateau.

This means that even for a hard impact of the ball, the contact time remains sufficiently high in order to hit the ball back in a controlled way.

In case of an 'overload' sufficient recovery of the contact time of the string according to the invention is possible (albeit less than with Big Banger Alu Power, displayed by BB Alu, but more than with the NXT).

Figure 8:
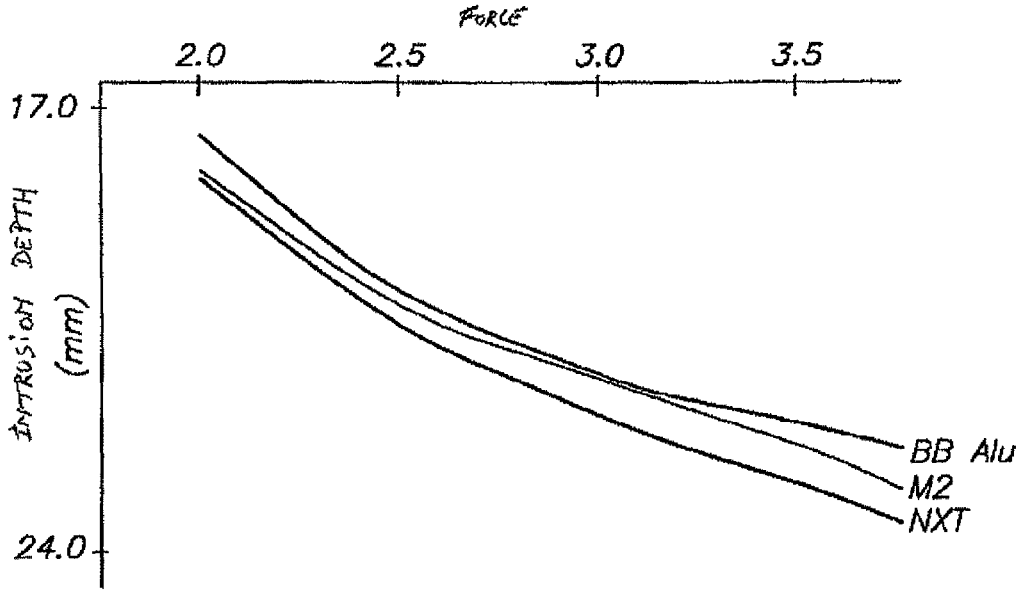
FIG. 8 displays a comparison of the intrusion depth of the ball in various strings.

FIG. 8 displays how deep a (non-deforming) ball enters into a string bed.

A comparison is made between a soft hit and a hard hit.

The deformation as displayed in the graph provides an idea on the stiffness of the string.

The figure shows that the string according to the invention as displayed by M2 behaves at a softer hit just like the NXT multifilament string and that a harder hit approximates the Big Banger Alu Power monofilament string, as displayed by BB Alu, more.

This indicates a changing ball feeling at various playing situations: the string is for instance 'stiffer' in case of a hard hit and gives a 'softer' feeling in case of a softer hit.

This invention also concerns a method for manufacturing the string according to the invention.

With the intention to better demonstrate the characteristics of the invention, hereinafter as an example without any limiting character, a preferential method for manufacturing a string according to the invention is displayed.

Furthermore, if necessary, the alkylbenzyl ester is added in advance to at least one molten polymer or polymer mixture for the creation of a homogeneous thermoplastic mixture in order to subsequently be extruded alone or together with other polymers or polymer mixtures in accordance with a desired pattern, by making use of two or more extruders and an especially designed spinning plates package.

Generally speaking at least one extruder is used for the island components and at least one extruder is used for the sea component.

Hereby the first plastic compound is extruded by a first series of openings in a mould and the second plastic compound is simultaneously extruded by a second series of openings in a mould at heightened temperature such that a bonding of the first and second plastic compound is obtained.

Furthermore, it should be taken into account that the various polymers or polymer mixtures can have a different melting point and it should be observed that the processing temperature is selected in such a way that at the melting point of the first polymer no degradation of the other polymers takes place.

Although one would expect that the thermoplastic elastomer degrades if it is heated up to a temperature that is too high, it was established that this effect in the string of this invention is negligible and a string with a good strength, tensile strength, consistent characteristics and lifespan is obtained.

After extrusion the obtained thread is first dried on the air and subsequently sent through a water bed for further cooling down.

Subsequently the thread is stretched in order to obtain a string with the desired diameter of 0.1 mm to 2 mm, preferably 0.6 to 1.4 mm.

To this means the thread is subsequently guided over various rolls, at increased temperature, temperature via ovens, infrared, microwaves, steam, hot water, et al.

Furthermore, the next roll constantly has a higher cycle time than the previous roll, with the exception of the last roll that has a lower cycle time, in order to provide the material of the thread with shrinking characteristics.

Subsequently the string is wound on a roll. The cycle time of the third roll can for instance be 4 to 12 times higher than the cycle time of the first roll.

However, one is capable to adjust the desired proportions, taking the intended stretching degree of the thread into account.

The cycle time of the rolls can be varied within broad limits, for example of 5 m/min for the first roll to 200 m/min for a third and/or fourth roll.

Therefore, the created string can if necessary finally still be subjected to a surface treatment, for example to a plasma treatment, for improvement or adjustment of the surface characteristics, for example of the capacity to be printed upon.

The present invention is by no means limited to the method and form(s) that were provided as an example and displayed in the figures, but a string or method according to the invention can in all sorts of ways and in all sorts of shapes and sizes be realised without leaving the framework of the invention.

The invention claimed is:

1. Monofilament racquet string, comprising a core material and a covering material that serves as a matrix in which the core material is embedded in the form of an 'island in the sea structure' and accordingly contains island components and a sea component, wherein the island components largely comprise a non-elastomeric thermoplastic polymer and are arranged in a geometrical pattern relative to each other and/or the longitudinal axis of the string, and at least three of said island components have a cross-section that has a multi-angular shape, with one side adjoining a surface of the string and wherein said at least one side has a curvature that closely follows the curvature of the string surface, and the other islands are circular or oval in form and are disposed in alternating relationship with the multi-angular shaped components circumferentially of the longitudinal axis in the sea and wherein the sea component largely comprises a thermoplastic elastomer.

2. Monofilament racquet string according to claim 1, wherein said non-elastomeric thermoplastic polymer comprises one or several non-elastomeric thermoplastic polymers or non-elastomeric polymer mixtures comprising PET, co-PET, PLA, PST, PPT, PA and or copolymers of these raw materials, PEEK, PPS, polyether polyester block polymer, polyether polyamide block polymer, TPU, PVDF and/or other fluorinated polymers.

3. Monofilament racquet string according to claim 1, wherein said non-elastomeric thermoplastic polymer comprises at least one polyester comprising a dicarboxylic acid selected from the group of phthalic acid, isophthalic acid, adipic acid, sebacic acid, 2.6 naphthalene dicarboxylic acid and a diol chosen from the group of a polyalkylene glycol, diethylene glycol, propyleneglycol, tetramethyleneglycol, 1,4-cyclohexane diol, or copolymers of these polyesters or blends of two or more of such polyesters or copolymers thereof.

4. Monofilament racquet string according to claim 1, wherein said thermoplastic elastomer comprises at least one polymer or polymer mixture comprising polyolefins, thermoplastic olefins (TPO); polyethylene and thermoplastic polyethylene; polypropene; ethylenepropene copolymers, EPDM, polyisoprene and copolymers thereof; polybutadiene and copolymers thereof; polyisobutylene and copolymers thereof; polyesters, polyethylene terephthalate (PET) and PLA, or copolymers thereof; thermoplastic polyurethane (TPU) and copolymers thereof; styrene-butadiene, styrene copolymers and block copolymers, polyethers, polyesters, polyetheresters, polyphenylene oxide, polyether etherketone (PEEK), PEEKK (polyether etherketoneketone), ABS, polymethylacrylate and polymethylmethacrylate, ethylenetetrafluorethylene, ethylene chlorotetrafluorethylene, polyvinylidene fluoride (PVDF), polymers based on teflon such as FEP, MFA and TFA and mixtures of two or more of these polymers or mixtures that contain one or more of the aforementioned polymers.

5. Monofilament racquet string according to claim 1, wherein said non-elastomeric thermoplastic polymer comprises at least alkylbenzyl ester of a 1,2 dicarboxylic acid, or one of its derivates, that is homogeneously distributed and wherein the alkyl chain of the alkylbenzyl ester, or one of its derivates, comprises at least five carbon atoms.

6. Monofilament racquet string according to claim 5, wherein the alkyl-benzyl ester comprises a diester of phthalic acid or phthalic acid anhydride, with on one hand a benzyl group and on the other hand an alkyl group with five to twelve carbon atoms.

7. Monofilament racquet string according to claim 1, wherein the non-elastomeric polymer comprises at least one of a thermoplastic polyurethane and/or a copolymer and/or a block copolymer and/or a mixture of two or more thermoplastic polyurethanes, wherein the shore hardness of said at least one non-elastomeric polymer is between A40 and D85.

8. Monofilament racquet string according to claim 1, wherein the island components comprise at least one of fluorinated polymers, including polyvinylidene fluoride, and/or a copolymer and/or a block copolymer and/or a mixture of two or more of said fluorinated polymers.

9. Monofilament racquet string according to claim 1, wherein the sea component comprises at least one elastomeric polymer comprising at least one of phthalates, polyethyleneterephthalate and/or a copolymer and/or a block copolymer and/or a mixture of two or more of said phthalates.

10. Monofilament racquet string according to claim 1, wherein the thermoplastic elastomer of the sea component comprises a mixture of polyvinylidenefluoride and polyethyleneterephthalate, or of one or several derivates thereof.

11. Monofilament racquet string according to claim 1, comprising three to twenty circumferentially arranged island components.

12. Monofilament racquet string according to claim 1, wherein at least a number of the circumferentially arranged island components are only partially embedded in the sea component and breach the surface of the string.

13. Monofilament racquet string according to claim 1, wherein several island components have a different diameter and/or have a different geometry from the other island components.

14. Monofilament racquet string according to claim 1, wherein the string has a rounded shape, and said multi-angular shaped islands and the circular or oval islands are respectively disposed co-axially with a wall of the string at respective first and a second distances from the longitudinal axis of the string.

15. Monofilament string according to claim 1, wherein the sea component and/or the island components contain an amount of nanoparticles created from one or several of the constituting thermoplastic elastomer and non-elastomeric polymers, respectively.

16. Monofilament string according to claim 1, wherein the island components and/or the sea component further comprise functional additives and/or fillers.

17. Monofilament string according to claim 1, wherein any sound that is produced by the string impacted under tension with a given force is constant.

18. Monofilament string according to claim 1, wherein the acoustic profile that is produced with a given type of hit on the string when tensioned is independent of the soil on the string and of whether the hit is produced indoors or outdoors.

19. Monofilament string according to claim 1, wherein when playing hard the same ball feeling is produced as with a monofilament string and when playing soft the feeling is the same as with a multifilament string, so that at a constant bending the string provides a constant ball control.

20. Method for manufacturing a monofilament racquet string according to claim 1, wherein at least two extruders are used, together with an adjusted spinning plates package, and the string is stretched after the extrusion.

* * * * *